US010278446B2

(12) United States Patent
Arai

(10) Patent No.: US 10,278,446 B2
(45) Date of Patent: May 7, 2019

(54) SHIELD FOR A HELMET

(71) Applicant: Michio Arai, Saitama-Ken (JP)

(72) Inventor: Michio Arai, Saitama-Ken (JP)

( * ) Notice: Subject to any disclaimer, the term of this patent is extended or adjusted under 35 U.S.C. 154(b) by 515 days.

(21) Appl. No.: 14/528,005

(22) Filed: Oct. 30, 2014

(65) Prior Publication Data

US 2015/0113713 A1 Apr. 30, 2015

(30) Foreign Application Priority Data

Oct. 31, 2013 (JP) ..... 2013-227433

(51) Int. Cl.
*A42B 3/22* (2006.01)

(52) U.S. Cl.
CPC ..... *A42B 3/226* (2013.01); *A42B 3/221* (2013.01); *A42B 3/227* (2013.01)

(58) Field of Classification Search
CPC ..... A42B 3/22; A42B 3/221; A42B 3/222; A42B 3/223; A42B 3/225; A42B 3/226; A42B 3/227; A42B 3/326
USPC ..... 2/6.3–6.8, 8.2–8.5, 8.7, 12, 15, 424
See application file for complete search history.

(56) References Cited

U.S. PATENT DOCUMENTS 3,636,565 A * 1/1972 Luisada ..... A42B 3/228 2/410
4,907,300 A * 3/1990 Dampney ..... A42B 3/228 2/424
5,113,535 A * 5/1992 Hedges ..... A42B 3/226 2/424
5,131,101 A * 7/1992 Chin ..... A42B 3/226 2/424
5,396,661 A * 3/1995 Sutter ..... A42B 3/223 2/6.4
5,461,731 A * 10/1995 Shida ..... A42B 3/222 2/424
5,467,480 A * 11/1995 Baudou ..... A42B 3/222 2/424
5,890,233 A * 4/1999 Kaffka ..... A42B 3/226 2/10
5,987,651 A * 11/1999 Tanaka ..... A42B 3/223 2/424

(Continued)

FOREIGN PATENT DOCUMENTS

DE 1265425 B * 4/1968 ..... A42B 3/226
JP 2-6608 1/1990

(Continued)

OTHER PUBLICATIONS

Partial English Abstract of JP HEI 6-83734.
Abstract and Partial English Translation of JP HEI 2-6608.
Abstract and Partial English Translation of JP 2005-248551.

*Primary Examiner* — Jameson D Collier
(74) *Attorney, Agent, or Firm* — Dykema Gossett PLLC

(57) ABSTRACT

A shield for a helmet includes a shield having a sun visor rotatably and axially supported at a position different from a rotation center of the shield. The sun visor rotates within a range from a first position where the sun visor, like a bill of a hat, lies above a front opening part and projects forward to a second position where the sun visor lies outside facing the shield in an overlapping manner, and the sun visor is retained in the first position. The sun visor is operated and moved forward and away from the shield to rotate from the first position to the second position.

1 Claim, 10 Drawing Sheets

(56) References Cited

U.S. PATENT DOCUMENTS

| | | | | |
|---|---|---|---|---|
| 6,260,213 | B1 * | 7/2001 | Eom | A42B 3/222 2/424 |
| 6,282,726 | B1 * | 9/2001 | Noyerie | A42B 3/225 2/424 |
| 6,301,721 | B1 * | 10/2001 | Arai | A42B 3/222 2/424 |
| 6,795,979 | B2 * | 9/2004 | Fournier | A42B 3/10 2/424 |
| 8,056,144 | B2 | 11/2011 | Gafforio et al. | |
| 8,250,669 | B2 * | 8/2012 | Gafforio | A42B 3/226 2/12 |
| 2002/0189005 | A1 * | 12/2002 | Taniuchi | A42B 3/223 2/424 |
| 2009/0038057 | A1 * | 2/2009 | Tews | A42B 3/24 2/424 |
| 2010/0064406 | A1 * | 3/2010 | Lee | A42B 3/226 2/10 |
| 2012/0284906 | A1 * | 11/2012 | Kuo | A42B 3/223 2/424 |
| 2012/0291185 | A1 * | 11/2012 | Basson | A42B 3/228 2/422 |

FOREIGN PATENT DOCUMENTS

| | | |
|---|---|---|
| JP | 6-83734 | 11/1994 |
| JP | 2005-248551 | 9/2005 |

* cited by examiner

SHIELD FOR A HELMET

TECHNICAL FIELD

The present invention relates to a shield for a helmet worn by a driver of moving equipment such as a motorbike or an automobile.

BACKGROUND ART

A shield for a helmet worn by a driver of a motorbike or an automobile during traveling is rotatably supported on right and left sides across a front opening part of the helmet. The shield is thus rotated to open and close the front opening part.

Furthermore, such shields for helmets include not only normal transparent shields but also colored transparent shields which avoid hindering the wearer's visibility and which have an anti-glare function. However, some of the colored transparent shields are considered to be inappropriate for driving during the night and the like depending on the density of the color.

A shield for a helmet described in Patent Literature 1 is known that includes a colored transparent sun visor (shielding element) outside the transparent shield, the sun visor avoiding hindering the wearer's visibility and having an anti-glare function.

In the shield, the sun visor is coaxially supported with the shield and rotatably and axially supported with respect to the shield as an independent and an integral member. The sun visor rotates within a range between a position where the sun visor lies opposite and in front of the shield in an overlapping manner and a position where the sun visor lies above the front opening part and away from the shield.

CITATION LIST

Patent Literature

Patent Literature 1: Japanese Published Patent Application No. 2006-2334

SUMMARY OF INVENTION

Technical Problem

The shield for the helmet described in Patent Literature 1 can demonstrate a function of anti-glare protection against sunlight when the sun visor is set in the position where the sun visor lies in front of the shield in an overlapping manner according to a brightness condition such as the position of sunlight or ambient light, and can provide high visibility during the night and the like when the sun visor is placed in the position where the sun visor lies above the front opening part and away from a first shield.

However, the conventional art described in Patent Literature 1 includes a complicated mechanism that coaxially rotates the shield and the sun visor as described above and has a large number of components. Thus, an attaching and detaching operation of the shield and the sun visor on and from the helmet is cumbersome and needs a considerably long time.

Furthermore, when located in a rotating upper end position, the sun visor may be brought down by wind pressure during traveling.

An example of an object of the present invention is to deal with these problems. That is, objects of the present invention are, for example, to allow the sun visor to rotate independently of the shield using a simple mechanism, thus enabling a reduction in the number of components, an easy attaching and detaching operation of the shield for the helmet on and from the helmet, and a reduction in the time needed for the attaching and detaching operation, to allow the rotating upper limit position of the sun visor to be reliably retained, and to facilitate an operation needed in connection with a change in traveling conditions.

Solution to Problem

To accomplish these objects, a shield for a helmet according to the present invention at least has the following configuration.

A shield for a helmet includes a shield on right and left sides of a shell providing an outermost layer of the helmet, the shield is rotatably and axially supported in a direction in which a front opening part of the shell is opened and closed, and a sun visor rotatably and axially supported on right and left sides on the shield at a position different from a rotation center of the shield, wherein the sun visor is configured to be used a transparent material that does not hinder visibility of a wearer of the helmet, and supported by a rotating guide part that guides rotation of the sun visor within a range from a first position where the sun visor, like a bill of a hat, lies above the front opening part and projects forward, to a second position where the sun visor lies outside opposite the shield in an overlapping manner, and the rotating guide part is configured to retain the sun visor in the first position and to pull out the sun visor retained in the first position in a direction forward and away from the shield thereby cancelling retention of the sun visor in the first position while enabling the sun visor to rotate to the second position.

DESCRIPTION OF EMBODIMENTS

Figure 1:
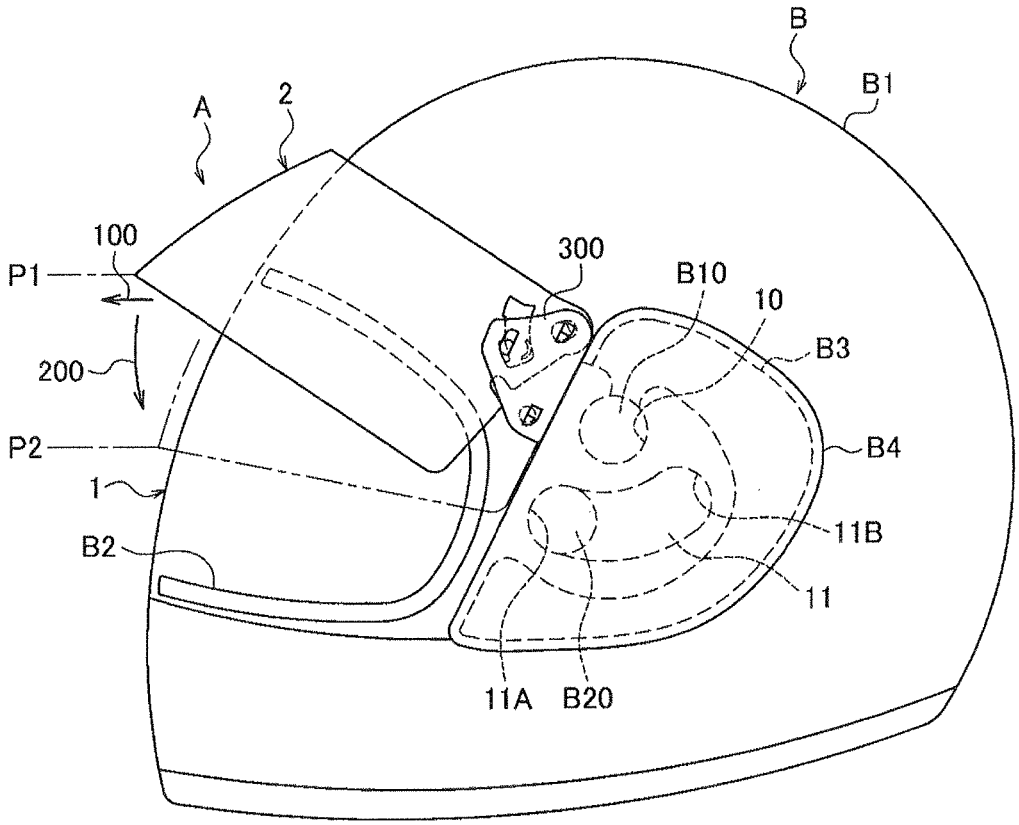
FIG. 1 is a side view of a helmet on which a shield for the helmet according to an embodiment of the present invention is implemented, with a sun visor set in a first position.
Figure 2:
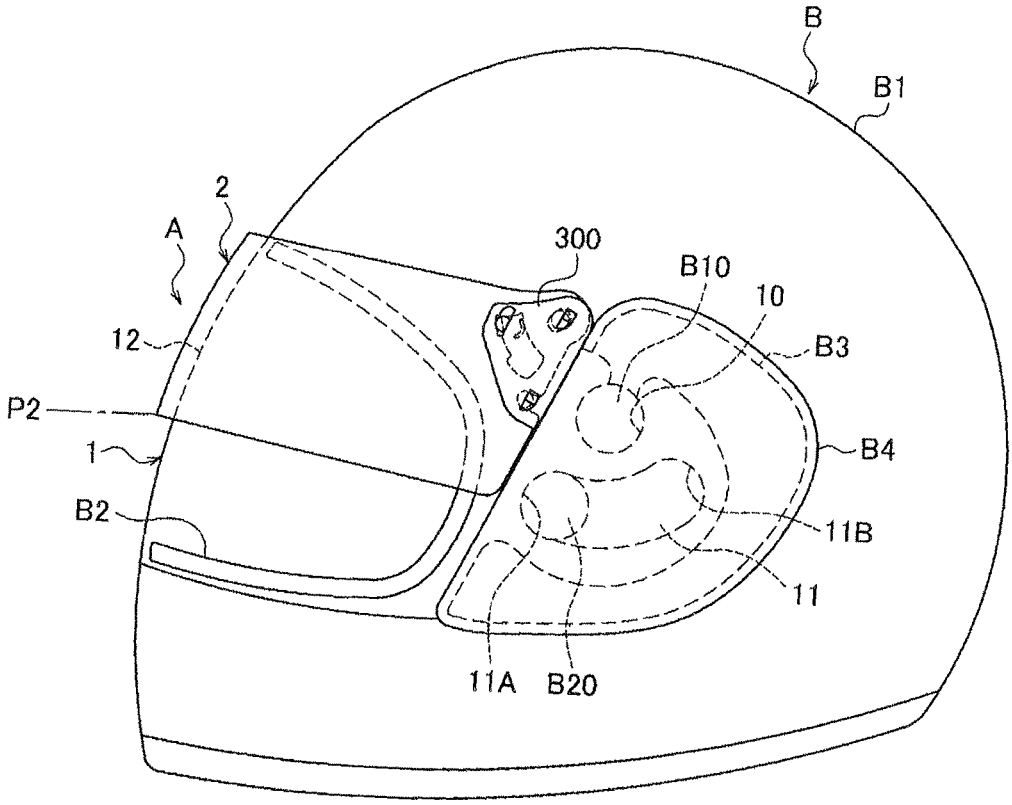
FIG. 2 is a side view of the helmet on which the shield for the helmet according to the embodiment of the present invention is implemented, with the sun visor set in a second position.

The rotating guide part preferably includes a spindle and a retaining part both provided on the shield side, the spindle having a shaft serving as a rotation center of the sun visor, the retaining part retaining a rotating operation of the sun visor, and a rotation supporting hole and a retaining hole both provided on the sun visor side, the rotation supporting hole rotatably engaging with the spindle and being formed like a long-hole in a longitudinal direction in which the shield is pulled out, and the retaining hole engaging with the retaining part and being formed like a long-hole in a longitudinal direction along a rotational orbit of the sun visor, the rotation supporting hole guides pulling-out of the sun visor along the longitudinal direction of the rotation supporting hole, the retaining part has a guide projection and an biasing part, the guide projection engaging with the retaining hole and guiding rotation of the sun visor, and the biasing part pushing back the sun visor toward the shield against an operation of pulling out the sun visor and giving an bias force so as to retain engagement of the retaining hole with the guide projection, the retaining hole has a retaining recessed part that is fitted with the guide projection at the first position the sun visor while the bias force of the biasing part acting on the retaining hole to retain the sun visor in the first position, and the retaining recessed part has a step which is locked on the guide projection when the sun visor rotates toward the second position while the retaining recessed part is in the fitted state and which, in the locked state, prevents the sun visor from rotating toward the second position, and the sun visor is pulled forward and away from the shield thereby cancelling fitting of the retaining recessed part with the guide projection and also cancelling locking of the retaining recessed part on the step, enabling the sun visor to rotate toward the second position.

Furthermore, preferably, the rotating guide part further has a retaining recessed part that is fitted with the guide projection and the biasing part while the sun visor is in the second position with the bias force exerted by the biasing part, and the retaining recessed part is fitted with the guide projection and the biasing part to retain the sun visor in the second position, the retaining recessed part has a step that contacts the guide projection when the sun visor rotates toward the first position while the retaining recessed part is in the fitted state, and when the sun visor rotates toward the first position, the step comes into contact with the guide projection and climbs over the guide projection against the bias force of the biasing part acting during the contact thereby cancelling fitting of the retaining recessed part with the guide projection and also canceling contact of the step with the guide projection, enabling the sun visor to rotate toward the first position.

The shell described below configures the outermost layer of the helmet and has a full face shape or an open face shape formed using, for example, a reinforced fiber resin material (GFRP, CFRP, or the like) formed by impregnating a reinforced fiber material (glass fibers, carbon fibers, or the like) with a thermosetting resin material (an epoxy resin material, a phenol resin material, or the like), or a thermoplastic resin material (polycarbonate or the like).

The helmet described below includes both a full face type and an open face type, and has a shock absorbing liner formed inside the shell using a styrofoam material or a material having shock absorbing performance equivalent to the shock absorbing performance of the styrofoam material, a head pad disposed inside the shock absorbing liner and formed of an urethane material, and cheek pads detachably installed on the inner surface of right and lift sides corresponding to the cheek parts of the shell.

The right and left in the description below refer to directions facing the right cheek and left cheek, respectively, of a wearer of the helmet. Furthermore, the front in the description below refers to the face side of the wearer of the helmet. Additionally, the up in the description below refers to the head top side of the helmet, and the down in the description below refers to the chin side of the helmet.

The shield in the description below refers to a transparent carbonate material or a transparent material having transparency and strength equivalent to transparency and strength of polycarbonate material, which is formed into a predetermined shape.

The sun visor in the description below refers to a colored transparent polycarbonate material colored so as to provide a sufficient transparency to ensure visibility and to demonstrate an anti-glare function for sunlight or a colored transparent material having transparency and strength equivalent to transparency and strength of polycarbonate material which is formed into a predetermined shape.

A shield A for a helmet according to an embodiment of the present invention will be described below based on FIGS. 1 to 5. The helmet B including the shield A for the helmet is of the full face type.

The shield A for the helmet has the same configuration on the right and left sides thereof and is supported on right and left sides of a shell B1 of the helmet B using the same configuration. Thus, only the left side is hereinafter illustrated and described.

Embodiments described below do not limit the present invention.

The shield A for the helmet is rotatably and axially supported in an up-down direction using, as the rotation center, a shaft supporting part B10 extending along a right and left direction of the shell B1 so that the rotation around the shaft supporting part B10 allows a front opening part B2 to be closed and opened.

The shield A for the helmet has a transparent shield 1 and a colored transparent sun visor 2 disposed outside the shield 1. The shield 1 is axially supported by the shaft supporting part B10, and the sun visor 2 is rotatably and axially supported in the up-down direction (the same direction in which the shield 1 rotates) with respect to the shield 1 and independently of the axis of the shield 1.

A mounting form of the shield 1 has a configuration substantially similar to the corresponding conventional configuration and will thus not be described in detail. The shaft supporting part B10 projects from each of base plates B3 secured to a right and a left outer surface, respectively, of the shell B1. An elastic engaging part B20 also projects from the base plate B3 to limit the rotating range of the shield 1. Moreover, shield presser covers B4 are disposed on the right and left outer surface, respectively, of the shell B1 so as to cover the base plates B3.

A mounting hole 10 and a guiding long-hole 11 are formed on an end side of the shield 1; the mounting hole 10 is fitted around the shaft supporting part B10, whereas the elastic engaging part B20 extends within the guiding long-hole 11.

The guiding long-hole 11 is shaped like a circular arc that is concentric with the mounting hole 10. The guiding long-hole 11 guides the shield 1, which rotates around the shaft supporting part B10 as the rotation center. An end of the guiding long-hole 11 contacts the elastic engaging part B20 to limit the rotation of the shield 1.

Furthermore, the elastic engaging part B20 comes into contact with the guiding long-hole 11 while being elastically deformed in a radial direction. This causes a force to be generated which allows recovery from the elastic deformation, and this recovery force provides resistance to the rotation of the shield 1. The elastic engaging part B20 is fitted into stopper parts 11A and 11B, respectively, formed at both ends of the guiding long-hole 11 to retain the shield 1 in a fully open state and a fully closed state.

A structure in which the sun visor 2 is mounted on the shield 1 will be described below. The sun visor 2 has an up-down width about two-thirds of the up-down width of the shield 1, and is rotatably supported in the up-down direction (same direction in which the shield 1 rotates) independently of the shield 1 via a base material (base bracket) 3 disposed on the shield 1.

The size of the sun visor may depend on a selling style restricted by standards or specifications for a country in which the sun visor is sold. Thus, the width of the sun visor in a rotating upper limit position (a first position) may need to meet visual field ranges in the respective standards.

The rotating range of the sun visor 2 is defined to be from a first position (an upper limit position) P1 where the sun visor 2, like a bill of a hat, lies above the front opening part B2 and projects forward to a second position (a lower limit position) P2 where the sun visor 2 lies facing the shield 1 outside a surface 12 of the shield 1.

That is, the sun visor 2 located in the first position P1 functions as a shade on the helmet B. The sun visor 2 located in the second position P2 demonstrates an anti-glare function for sunlight.

As depicted in FIGS. 6 to 9, the sun visor 2 is supported such that a rotating guide part 4 provided both for the sun visor 2 and the base material 3 allows guiding of rotation of the sun visor 2, definition of the rotating range of the sun visor 2, and retention and cancellation of retention of the sun visor 2 in the first position P1.

The base material 3 is positioned at an upper front end of the shield presser cover B4 and above an upper end of the front opening part B2. The base material 3 is formed so as to avoid overlapping the front opening part B2.

Figure 4:
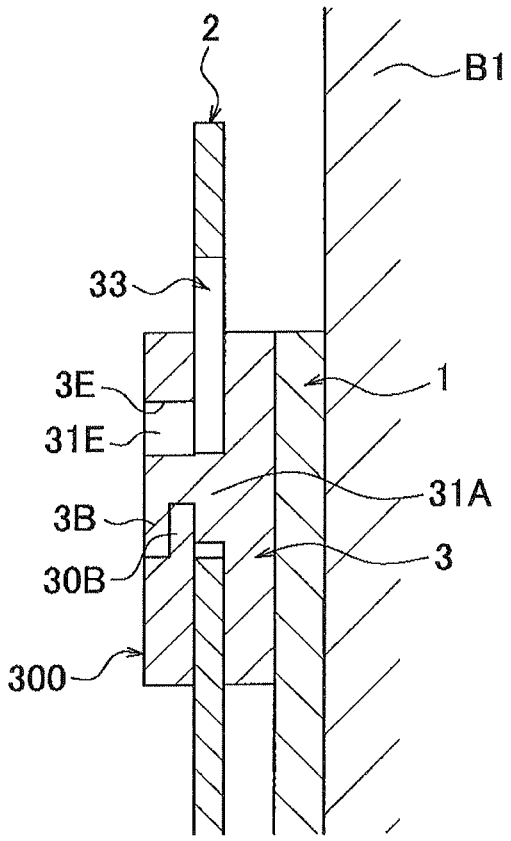
FIG. 4 is a cross-sectional view taken along line (IV)-(IV) in FIG. 3.
Figure 5:
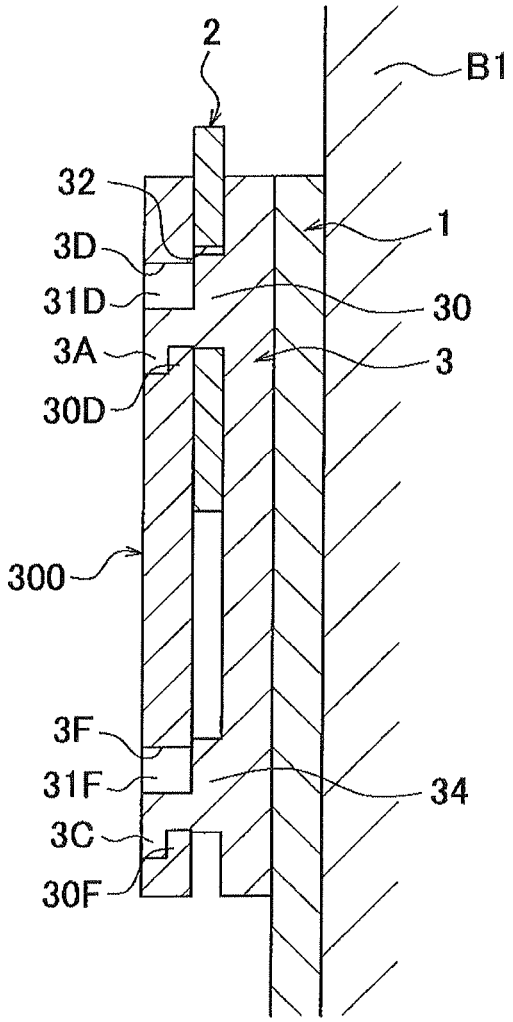
FIG. 5 is a cross-sectional view taken along line (V)-(V) in FIG. 3.

The base material 3 is covered with a retaining cover 300. As depicted in FIG. 4 and FIG. 5, the retaining cover 300 covers the base material 3 so as to sandwich the sun visor 2 with the base material 3 and to rotate the sun visor 2 between the retaining cover 300 and the base material 3.

The rotating guide part 4 is disposed between the shield 1 and the sun visor 2 and includes a spindle 30 and a retaining part 31 both projecting from the base material 3 secured to the surface of the shield 1 and a rotation supporting hole 32 and a retaining hole 33 both formed in the sun visor 2. The rotation supporting hole 32 is engaged with the spindle 30 and the retaining hole 33 is engaged with the retaining part 31 to allow the sun visor 2 to be mounted on the shield 1.

The spindle 30 has a shaft extending along the right and left direction of the shell B1 and is axially supported such that the rotation supporting hole 32 engages with the spindle 30 to allow the sun visor 2 to rotate in the up-down direction between the first position P1 and the second position P2 around the spindle 30 as the rotation center.

The retaining part 31 has a guide projection 31A projecting parallel to the shaft of the spindle 30 and a circular arc-shaped spring part (biasing part) 31B that is elastically deformed in the radial direction. The retaining hole 33 engages with the retaining part 31 to elastically deform the spring part 31B in the radial direction.

When the retaining hole 33 engages with the retaining part 31, the spring part 31B comes into contact with the retaining hole 33 while being elastically deformed in the radial direction. This allows generation of a force (bias force) that recovers from the elastic deformation so that the recovery force provides resistance to the rotation of the sun visor 2.

The rotation supporting hole 32 is formed to be a long-hole that is long in a front-rear direction so that the sun visor 2 can be moved in the front-rear direction within the range of the length of the rotation supporting hole 32.

The retaining hole 33 is concentric with the spindle 30 and is formed to be a circular arc-shaped long-hole extending along the rotational orbit of the sun visor 2. The retaining hole 33 guides the sun visor 2, which rotates around the spindle 30 as the rotation center. An end of the retaining hole 33 contacts the retaining part 31 to limit the rotation of the sun visor 2.

The retaining hole 33 includes, on a lower end side thereof, a retaining recessed part 33A into which the guide projection 31A is fitted. The guide projection 31A is fitted into the retaining recessed part 33A to retain the sun visor 2 in the first position P1.

The retaining hole 33 includes, on an upper end side thereof, a retaining recessed part 33B into which the guide projection 31A is fitted. The guide projection 31A is fitted into the retaining recessed part 33B to retain the sun visor 2 in the second position P2.

Figure 6:
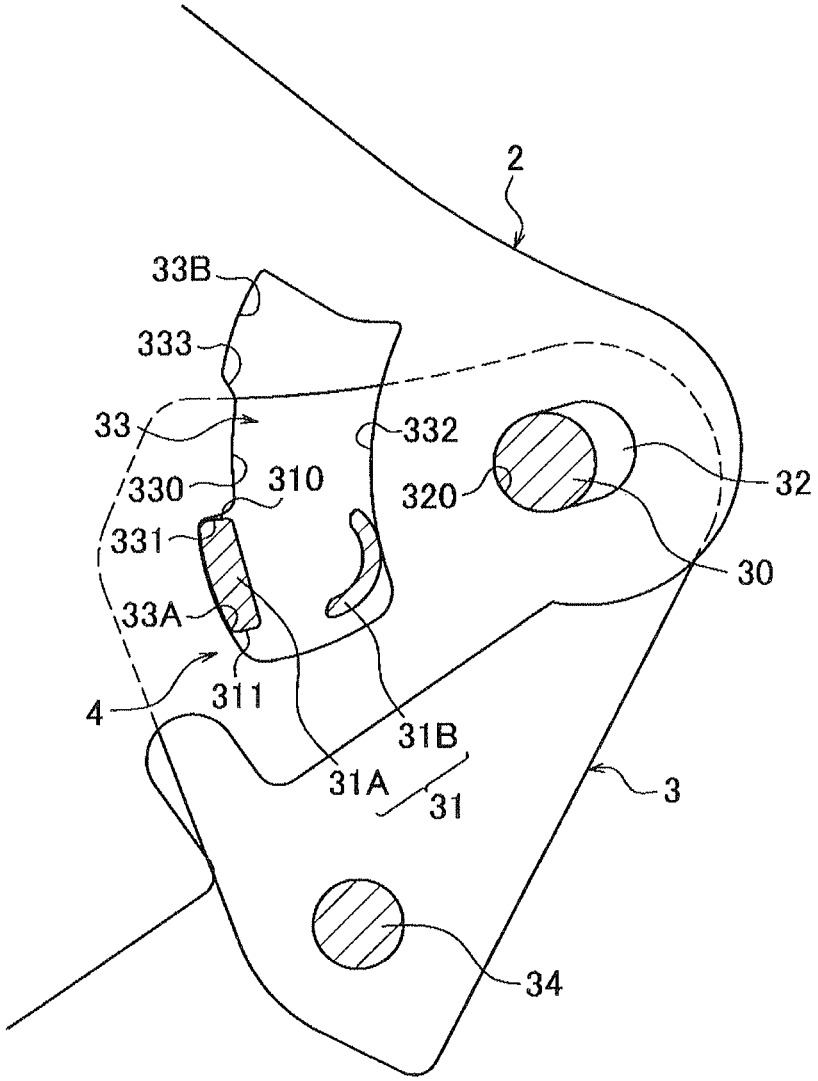
FIG. 6 illustrates that the sun visor is retained in the first position.

As depicted in FIG. 6, the retaining recessed part 33A is formed by notching a lower end side of a front edge 330 of the retaining hole 33 forward. A step 331 formed on an upper side of the thus formed retaining recessed part 33A faces and contacts a locking surface 310 of the guide projection 31A formed so as to engage with the step 331, to prevent the sun visor 2 from rotating from the first position P1 to the second position P2.

The step 331 is formed in a direction crossing the front edge 330 approximately at a right angle. Thus, when a force is applied to the sun visor 2 so as to rotate the sun visor 2 toward the second position P2, the step 331 reliably keeps a contact state facing the locking surface 310 of the guide projection 31A of the step 331 to prevent the step 331 from climbing over the guide projection 31A.

With the guide projection 31A fitted in the retaining recessed part 33A, the spring part 31B, while being elastically deformed, comes into contact with a rear edge 332 facing the retaining recessed part 33A in a width direction of the retaining hole 33. A force of the spring part 31B allowing the recovery from the elastic deformation acts on the rear edge 332 to push the rear edge 332 rearward, while pressing the retaining recessed part 33A against the guide projection 31A. Thus, the guide projection 31A can remain fit in the retaining recessed part 33A.

With the sun visor 2 in the first position P1, the guide projection 31A is retained by the retaining recessed part 33A, and as depicted in FIG. 6, the force of the spring part 31B allowing the recovery from the elastic deformation acts to press the sun visor 2 rearward toward the shell B1 side, with the spindle 30 in contact with a front end 320 of the rotation supporting hole 32.

Furthermore, since, in the first position P1, the force of the spring part 31B allowing the recovery from the elastic deformation acts to press the sun visor 2 rearward toward the shell B1 side, possible backlash of the sun visor 2 during traveling can be prevented.

Figure 7:
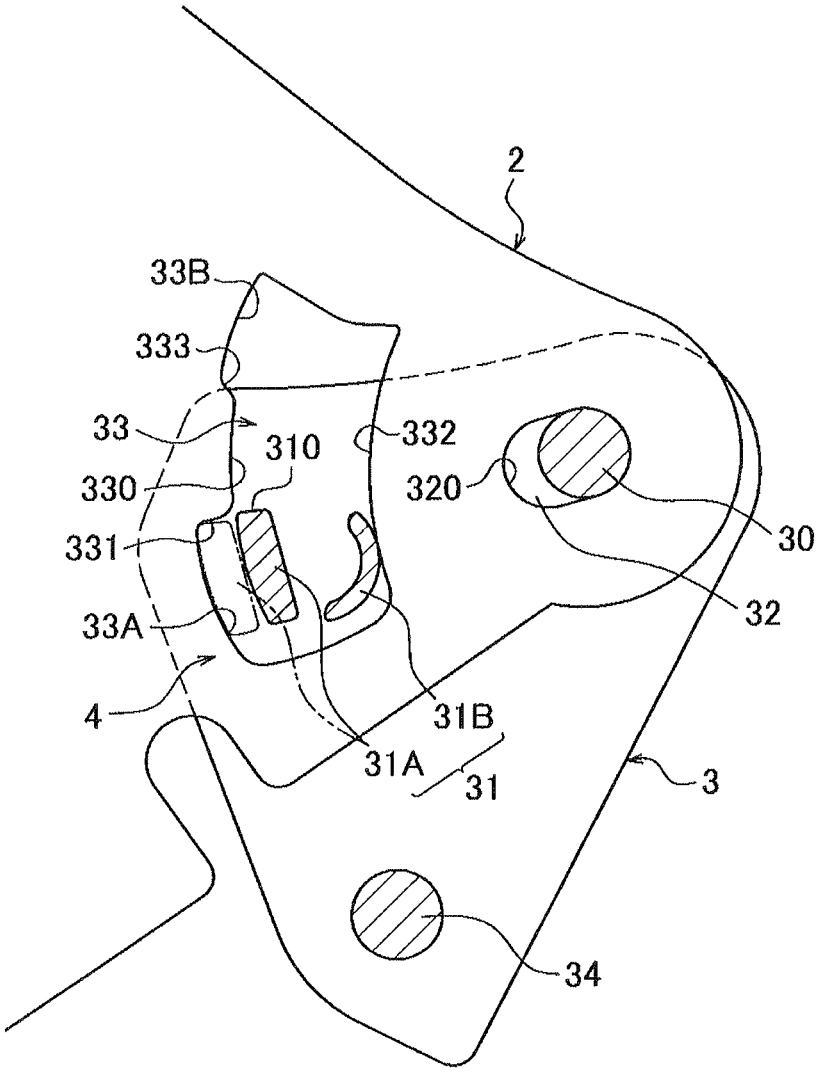
FIG. 7 is a diagram depicting an operation of the sun visor in which retention of the sun visor in the first position is canceled.

The sun visor 2 retained in the first position P1 is rotated downward by being pulled forward and separated from the shield 1 (movement in a direction depicted by arrow 100 in FIG. 1) against the force of the spring part 31B allowing the recovery from the elastic deformation. In the downward rotation, an operation normally not performed is executed to slide the sun visor 2 forward to correspondingly move the retaining recessed part 33A forward and away from the guide projection 31A, while unlocking the step 331 from the locking surface 310 of the guide projection 31A to make the step 331 no longer retained, as depicted in FIG. 7.

That is, when the sun visor 2 is slid forward, the step 331 is no longer held by the locking surface 310 of the guide projection 31A. Thus, the retention of the sun visor 2 in the first position P1 is canceled to enable the sun visor 2 to rotate toward the second position P2.

Figure 8:
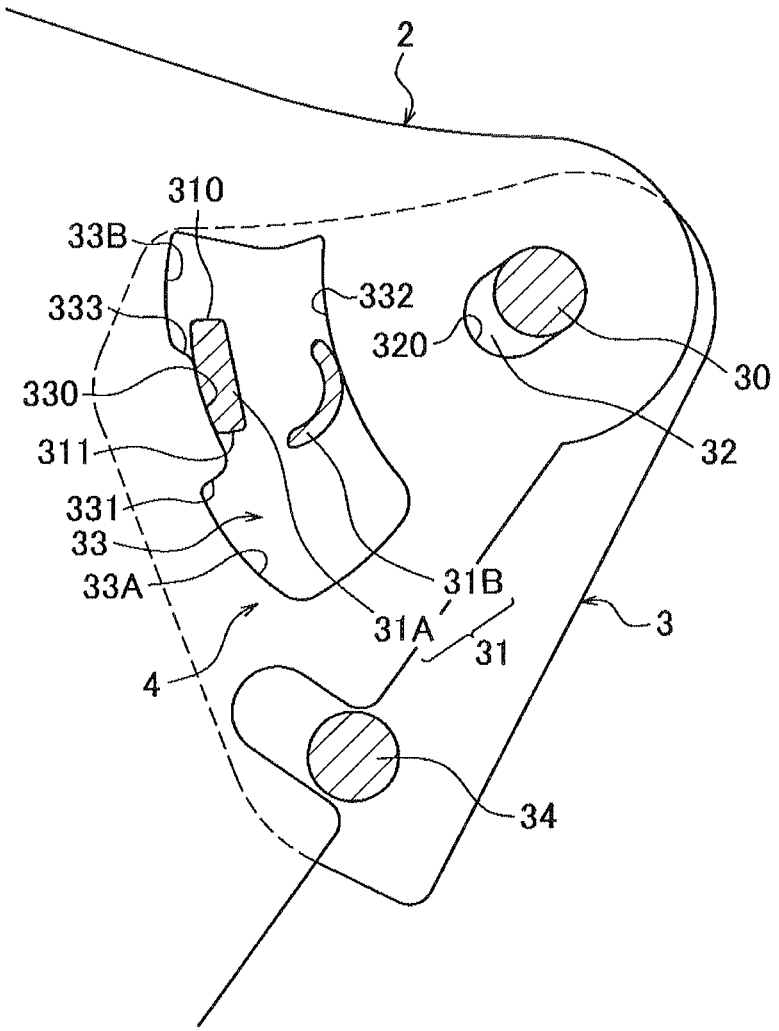
FIG. 8 is a diagram depicting an operation of the sun visor in which the sun visor is rotated toward the second position.

Furthermore, when the sun visor 2 is slid forward to rotate toward the second position P2 (as depicted by arrow 200 in FIG. 1), the front edge 330 of the retaining hole 33 comes into contact with the guide projection 31A to allow the sun visor 2 to rotate while being guided by the guide projection 31A, as depicted in FIG. 8.

When the front edge 330 is positioned in contact with the guide projection 31A, the elastically deformed spring part 31B contacts the rear edge 332 of the retaining hole 33. Then, the force allowing the recovery from the elastic deformation acts to press the front edge 330 against the guide projection 31A. This provides resistance to the contact of the front edge 330 with the guide projection 31A, allowing prevention of possible backlash of the sun visor 2 during a rotating operation.

Figure 9:
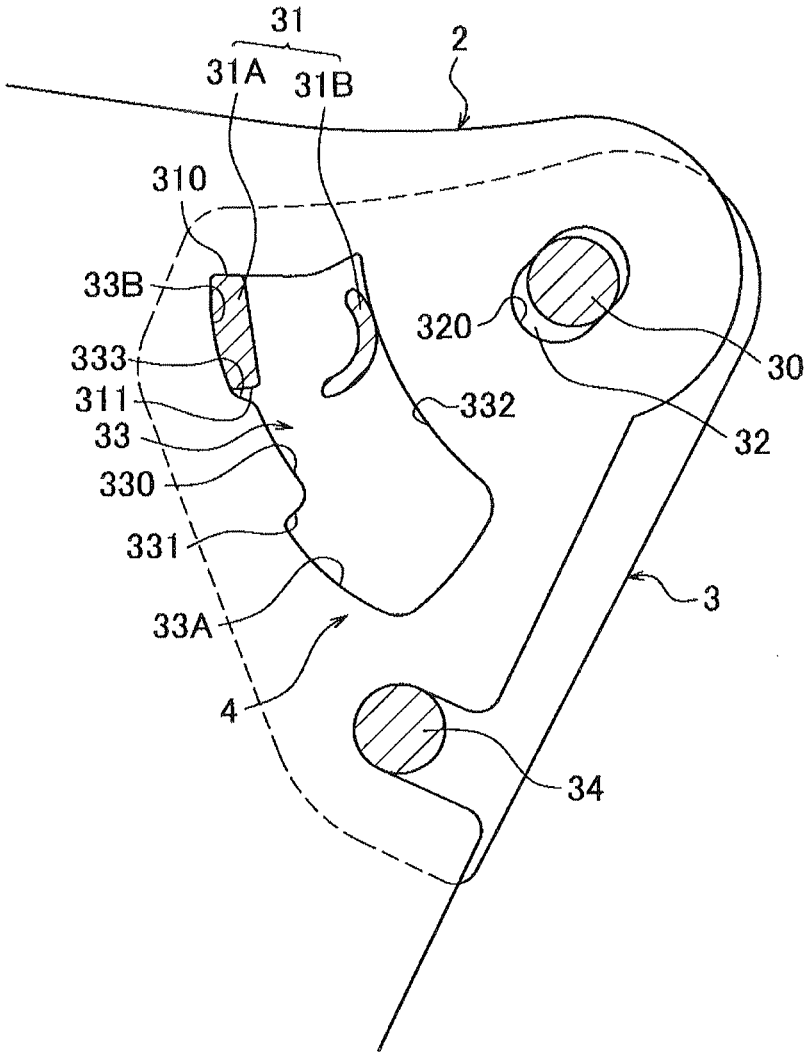
FIG. 9 is a diagram depicting an operation of the sun visor in which the sun visor is retained in the second position.
Figure 10:
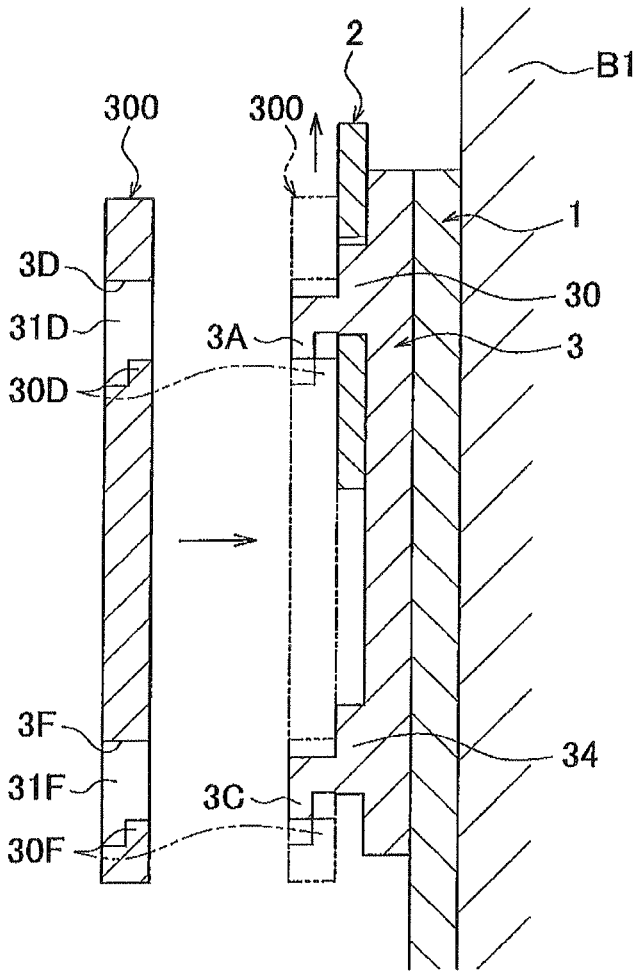
FIG. 10 is a cross-sectional view of an operation of attaching a retaining cover depicted in FIG. 5.

When the sun visor 2 reaches the second position P2, the retaining recessed part 33B is fitted with the guide projection 31A, and the elastically deformed spring part 31B comes into contact with the rear edge 332, as depicted in FIG. 9. Then, the force allowing the recovery from the elastic deformation acts to retain the fitting of the retaining recessed part 33B over the guide projection 31A.

Like the retaining recessed part 33A, the retaining recessed part 33B is formed by notching an upper end side of the front edge 330 of the retaining hole 33 forward. When a lower end side step 333 of the retaining recessed part 33B allows the sun visor 2 to rotate from the second position P2 to the first position P1, the retaining recessed part 33B contacts a contact surface 311 of the guide projection 31A formed to be facing and in contact with the step 333.

The retaining recessed part 33B is smaller than the retaining recessed part 33A in depth. The lower end side step 333 of the retaining recessed part 33B forms a slope.

When the sun visor 2 rotates toward the first position P1, the step 333 comes into contact with the contact surface 311 of the guide projection 31A. However, since the step 333 forms the slope, the step 333 can climb over the guide projection 31A while being guided by the contact surface 311 of the guide projection 31A, against the force of the spring part 31B exerted during the contact to allow the recovery from the elastic deformation.

Thus, while the sun visor 2 is rotating toward the first position P1, even when the step 333 comes into contact with the guide projection 31A, the rotation of the sun visor 2 can be implemented against the resistance to the rotation.

The step 333 is not limited to the illustrated slope but may extend in a direction crossing the front edge 330 approximately at a right angle. Alternatively, the contact surface 311 of the guide projection 31A may be shaped like a slope or a circuit arc surface with a radius longer than the length of the step 333.

Thus, even when the step 333 comes into contact with the guide projection 31A while the sun visor 2 is rotating toward the first position P1, the step 333 can climb over the guide projection 31A while being guided by the contact surface 311 of the guide projection 31A. Consequently, the resistance to the rotation of the sun visor 2 can be overcome to allow the rotation to be achieved.

The above-described rotating guide part 4 allows the sun visor 2 to be firmly retained in the first position P1. Furthermore, the sun visor 2 can be rotated to the second position P2 by performing the special operation of pulling the sun visor 2 forward.

Additionally, the sun visor 2 can be retained in the second position P2, and simply rotating the sun visor 2 upward enables the retention to be cancelled to allow the sun visor 2 to rotate toward the first position P1. The sun visor 2 having reached the first position P1 can then be firmly retained in the first position P1.

As depicted in FIGS. 3 to 5 and FIG. 10, the base material 3 includes fitting parts 3A, 3B, and 3C that are fitted into three fitting holes 3D, 3E, and 3F in the retaining cover 300. The retaining cover 300 can be attached to the base material 3 by fitting the fitting parts 3A, 3B, and 3C into the fitting holes 3D, 3E, and 3F.

Figure 3:
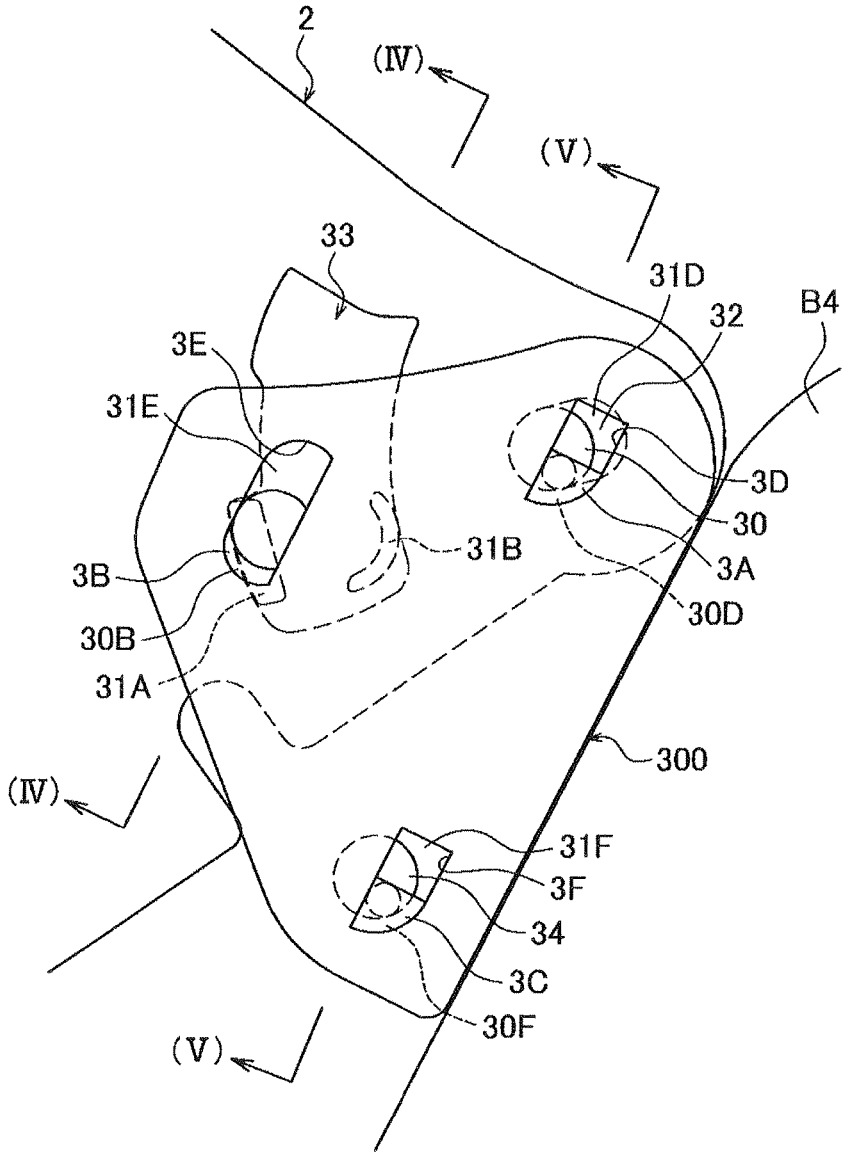
FIG. 3 is an enlarged diagram of an essential part of FIG. 1.

Now, configurations of the fitting parts 3A, 3B, and 3C and the fitting holes 3D, 3E, and 3F will be described. As depicted in FIGS. 3 to 5, the fitting parts 3A, 3B, and 3C are shaped like plates and integrated with a tip of the spindle 30, a tip of the guide projection 31A of the retaining part 31, and a tip of a shaft part 34 projecting from the base material 3, respectively.

The fitting parts 3A, 3B, and 3C project in the radial direction from outer peripheries of the spindle 30, the guide projection 31A, and the shaft part 34, respectively.

When the fitting part 3A engages with a step part 30D formed at a lower edge of the fitting hole 3D, the fitting part 3B engages with a step part 30E formed at a lower edge of the fitting hole 3E, and the fitting part 3C engages with a step part 30F formed at a lower edge of the fitting hole 3F so that the fitting parts 30A, 30B, and 30C overlap the step parts 30D, 30E, and 30F, respectively, in a thickness direction of the retaining cover 300, the retaining cover 300 is attached to the base material 3.

The fitting holes 3D, 3E, and 3F are each formed to be a long-hole that is long in the up-down direction. Spaces 31D, 31E, and 31F are each formed between an upper end of the corresponding one of the fitting holes 3D, 3E, and 3F and a tip edge of the corresponding one of the step parts 30D, 30E, and 30F to enable the fitting parts 3A, 3B, and 3C to be fitted into the fitting holes 3D, 3E, and 3F, respectively, in the thickness direction of the retaining cover 300.

The retaining cover 300 with the fitting holes 3D, 3E, and 3F formed therein is attached to the base material 3 as follows. With the spaces 31D, 31E, and 31F facing the fitting parts 3A, 3B, and 3C, respectively, the retaining cover 300 is placed facing the base material 3 and pushed toward the base material 3 so as to fit the spaces 31D, 31E, and 31F over the fitting parts 3A, 3B, and 3C, respectively.

Moreover, with the spaces 31D, 31E, and 31F fitted with the fitting parts 3A, 3B, and 3C, respectively, the retaining cover 300 is moved upward to allow the fitting parts 3A, 3B, and 3C to engage with the step parts 30D, 30E, and 30F, respectively.

Thus, the retaining cover 300 can be attached to the base material 3.

To retain the engagement between the step parts 30D, 30E, and 30F and the fitting parts 3A, 3B, and 3C, respectively, the step parts 30D, 30E, and 30F and the fitting parts 3A, 3B, and 3C are formed to be elastically deformed while generating contact resistance in association with the force allowing the recovery from the elastic deformation when the engagement is made in an overlapping manner.

Due to the above configuration, downward displacement of the retaining cover 300 along the base material 3 is prevented, whereby the attachment of the retaining cover 300 can be maintained.

Furthermore, the thickness of each of the fitting parts 3A, 3B, and 3C is set such that, when the fitting parts 3A, 3B, and 3C engage with the with the step parts 30D, 30E, and 30F, respectively, tip surfaces of the fitting parts 3A, 3B, and 3C are flush with a surface of the retaining cover 300.

This allows prevention of formation of projecting areas such as protrusions on a surface of the helmet B.

Furthermore, the widths of the fitting parts 3A, 3B, and 3C are set to be compatible with the widths of the fitting holes 3D, 3E, and 3F, respectively. This allows the retaining cover 300 to be attached to the base material 3 without causing backlash of the retaining cover 300 in the front-rear direction.

The retaining cover 300 can be detached by performing an operation reverse to the above-described attachment operation.

In the above-described shield A for the helmet, the independent rotation of the sun visor 2 with respect to the shield 1 can be achieved by a mechanism simpler than the corresponding mechanism in Patent Literature 1. Thus, the further reduction in the number of components can be accomplished than Patent Literature 1.

Furthermore, the sun visor 2 is attached to the shield 1, and thus, the shield A for the helmet can be attached by rotatably and axially supporting the shield 1 on the shell B1. This facilitates easy attaching and detaching operation of the shield A for the helmet on and from the helmet B and cuts the time needed for the attaching and detaching operation.

Additionally, the sun visor function can be added to an existing helmet that shares the shield 1 without modification or the like of the helmet main body.

In addition, in the first position P1 where the sun visor 2 is used as a shade for the helmet B, the rotating guide part 4 retains the sun visor 2 so as to prevent the sun visor 2 from rotating to the second position P2 unless the special operation of pulling the sun visor 2 forward and away from the shield 1 is performed. Thus, even when wind pressure or the like that causes the sun visor 2 to rotate to the second position P2 is applied to the sun visor 2, the sun visor 2 can be retained in the first position P1.

Furthermore, in the second position P2 where the sun visor 2 demonstrates a function of anti-glare protection against sunlight, the sun visor 2 can be rotated to the first position P1 by performing the normal operation of rotating the sun visor 2 upward.

Additionally, when the sun visor 2 reaches the first position P1, the rotating guide part 4 can retain the sun visor 2 so as to prevent the sun visor 2 from rotating to the second position P2 unless the special operation of pulling the sun visor 2 forward and away from the shield 1 is performed.

In addition, the special operation performed when the sun visor 2 is in the first position P1 is an easy operation of pulling the sun visor 2 forward and away from the shield 1. Moreover, the sun visor 2 can be rotated from the second position P2 to the first position P1 by performing only the normal operation of rotating the sun visor 2 upward. Thus, the operation of rotating the sun visor 2 between the first position P1 and the second position P2 can be quickly and reliably achieved.

Therefore, the sun visor 2 can be reliably fixed in the first position (the upper limit position) P1, and the operation needed for the sun visor 2 in connection with a change in traveling conditions can be facilitated.

REFERENCE SIGNS LIST

A: Shield for helmet
B: Helmet
B1: Shell
B2: Front opening part
1: Shield
2: Sun visor
4: Rotating guide part
P1: First position
P2: Second position
30: Spindle
31: Retaining part
32: Rotation supporting hole
33: Retaining hole
31A: Guide projection
31B: Spring part (biasing part)
33A: Retaining recessed part
33B: Retaining recessed part
331: Step
333: Step

The invention claimed is:

1. An assembly for use with a helmet having a front opening, left and right sides, and respective left and right shaft-supporting parts at said left and right sides of the helmet, said assembly comprising:

a shield having left and right ends and including a mounting hole in each of said left and right ends for cooperation with said respective left and right shaft-supporting parts when the shield is attached to the helmet to enable up and down rotation relative to the front opening, and left and right base brackets attached to an outer surface of the shield near the respective left and right ends of the shield, each of the left and right base brackets providing an outwardly-extending spindle;

a sun visor having left and right ends and including respective left and right supporting holes at the respective left and right ends of the sun visor and into which the respective spindles of the left and right base brackets extend to enable rotational movement of the sun visor relative to the shield between first and second positions;

wherein each of said left and right supporting holes of said sun visor is elongated to enable said sun visor to be moved outwardly from or inwardly toward the shield; and wherein said sun visor includes left and right elongated retaining holes at the respective left and right ends of the sun visor forwardly of the respective left and right supporting holes, and each said left and right base brackets providing a guide projection and a spring element which extend into the respective left and right elongated retaining holes to contact opposite sides of the respective retaining holes and enable positioning of the sun visor in either of said first position or said second position.

* * * * *